US007841839B2

(12) United States Patent
Inoue et al.

(10) Patent No.: US 7,841,839 B2
(45) Date of Patent: Nov. 30, 2010

(54) DISPLACEMENT CONTROL STRUCTURE FOR A VARIABLE DISPLACEMENT COMPRESSOR

(75) Inventors: Yoshinori Inoue, Kariya (JP); Atsuhiro Suzuki, Kariya (JP); Hiroyuki Nakaima, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 771 days.

(21) Appl. No.: 11/894,321

(22) Filed: Aug. 20, 2007

(65) Prior Publication Data

US 2008/0063540 A1 Mar. 13, 2008

(30) Foreign Application Priority Data

Aug. 21, 2006 (JP) ..... P2006-224206

(51) Int. Cl.
*F04B 1/26* (2006.01)
*F25B 49/00* (2006.01)

(52) U.S. Cl. ..... 417/222.2; 417/213; 417/270; 62/228.3

(58) Field of Classification Search ..... 417/213, 417/222.1, 222.2, 270, 312; 62/192, 228.3, 62/470

See application file for complete search history.

(56) References Cited

U.S. PATENT DOCUMENTS

| | | | | |
|---|---|---|---|---|
| 5,823,294 | A * | 10/1998 | Mizutani et al. | 184/6.3 |
| 5,971,716 | A * | 10/1999 | Ota et al. | 417/222.2 |
| 6,174,140 | B1 * | 1/2001 | Ota et al. | 417/222.2 |
| 7,243,502 | B2 | 7/2007 | Umemura et al. | |
| 2001/0053327 | A1 | 12/2001 | Yokomachi et al. | |

* cited by examiner

*Primary Examiner*—Charles G Freay
(74) *Attorney, Agent, or Firm*—Locke Lord Bissell & Liddell LLP

(57) ABSTRACT

A variable displacement compressor includes a housing assembly. A displacement control structure for the variable displacement compressor includes a passage forming member, a flat partition and a displacement control valve. The passage forming member is connected to an exterior surface of the housing assembly for forming a refrigerant passage for allowing the refrigerant to be discharged out from the compressor to an external refrigerant circuit. The flat partition is interposed between the passage forming member and the housing assembly. A throttle penetrates through the partition, which divides the refrigerant passage into an upstream passage and a downstream passage. The displacement control valve is provided in the passage forming member. The displacement control valve senses pressure of refrigerant in the upstream passage and pressure of the refrigerant in the downstream passage to control flow rate of the refrigerant flowing through a supply passage.

7 Claims, 3 Drawing Sheets

DISPLACEMENT CONTROL STRUCTURE FOR A VARIABLE DISPLACEMENT COMPRESSOR

BACKGROUND OF THE INVENTION

The present invention relates to a displacement control structure for a variable displacement compressor.

The variable displacement compressor as disclosed by Japanese Patent Application Publication No. 2001-355570 or No. 2004-197679 detects if the flow rate of refrigerant is appropriate and controls the valve opening of the displacement control valve thereof. The latter reference discloses the displacement control valve whose valve opening is changed by difference of pressure between two points upstream and downstream of the throttle provided in a passage for discharge refrigerant. In the displacement control valve, urging force caused by the pressure difference is opposed to electromagnetic force generated by applying electric current to a solenoid through a valve body, and the valve body is arranged so as to be balanced between the urging force caused by the pressure difference and the electromagnetic force thereby to specify the valve opening.

The above pressure difference increases as the refrigerant flow rate increases. The pressure difference reflects the refrigerant flow rate, and in the variable displacement compressor the valve opening increases as the pressure difference increases. When the refrigerant flow rate exceeds an appropriate flow rate, the valve opening increases thereby to increase the flow rate of refrigerant supplied from the discharge chamber to the crank chamber through the valve hole. This causes the pressure in the crank chamber to be risen thereby to decrease inclination angle of the swash plate, which decreases the refrigerant flow rate so as to converge to the appropriate flow rate. When the refrigerant flow rate becomes lower than the appropriate flow rate, the valve opening decreases thereby to decrease the flow rate of refrigerant supplied from the discharge chamber to the crank chamber through the valve hole. This causes the pressure in the crank chamber to be fallen thereby to increase the inclination angle of the swash plate, which increases the refrigerant flow rate so as to converge to the appropriate flow rate.

The displacement control valve is built in the rear housing and the throttle is provided in a conduit of an external refrigerant circuit.

In the structure where the displacement control valve is built in the rear housing, however, passages are complicatedly formed. In the passages are included a passage through which pressure of the refrigerant upstream of the throttle of the conduit of the external refrigerant circuit acts on the displacement control valve, a passage through which the pressure of refrigerant downstream of the throttle acts on the displacement control valve, and a passage through which the refrigerant is supplied from the displacement control valve to the crank chamber. In addition, although a passage forming portion is needed for ensuring a part of these passages in the rear housing, the passage forming portion which forms a part of the rear housing causes the weight of the rear housing to be increased, which increases the weight of the compressor.

The present invention is directed to a displacement control structure which prevents structural complexity of passages through which pressure of the refrigerant upstream and downstream of the throttle respectively act on the displacement control valve, and which also prevents the increase of the weight of the variable displacement compressor.

SUMMARY OF THE INVENTION

In accordance with an aspect of the present invention, a variable displacement compressor includes a housing assembly having a pressure control chamber and a suction pressure region. Refrigerant in a discharge pressure region is supplied to the pressure control chamber through a supply passage while the refrigerant in the pressure control chamber flows into the suction pressure region through a bleed passage whereby pressure in the pressure control chamber is adjusted to control displacement of the compressor. A displacement control structure for the variable displacement compressor includes a passage forming member, a flat partition and a displacement control valve. The passage forming member is connected to an exterior surface of the housing assembly for forming a refrigerant passage for allowing the refrigerant to be discharged out from the compressor to an external refrigerant circuit. The flat partition is interposed between the passage forming member and the housing assembly. A throttle penetrates through the partition, which divides the refrigerant passage into an upstream passage and a downstream passage. The displacement control valve is provided in the passage forming member. The displacement control valve senses pressure of the refrigerant in the upstream passage and pressure of the refrigerant in the downstream passage to control the flow rate of the refrigerant flowing through the supply passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
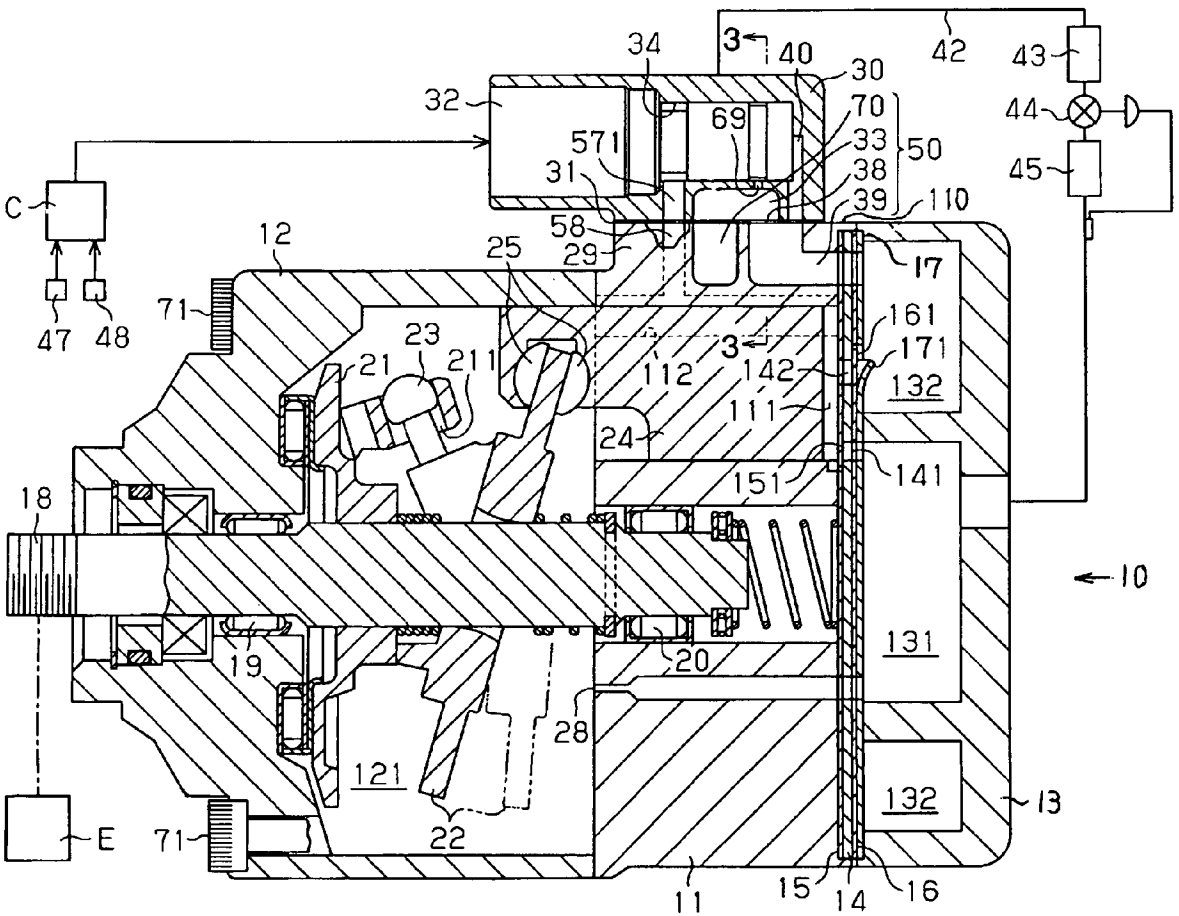
FIG. 1 is a longitudinal sectional view showing a variable displacement compressor according to a first embodiment of the present invention.

The following will describe a first embodiment according to the present invention with reference to FIGS. 1 through 6. As shown in FIG. 1, a variable displacement compressor 10 has a housing assembly including a cylinder block 11, a front housing 12 and a rear housing 13. The front housing 12 is connected to the front end (the left end as seen in FIG. 1) of the cylinder block 11. The rear housing 13 is connected to the rear end (the right end as seen in FIG. 1) of the cylinder block 11 through a valve plate 14, valve forming plates 15 and 16 and a retainer forming plate 17. These components are connected together via bolts 71.

The front housing 12 and the cylinder block 11 cooperate to define a pressure control chamber 121 through which a rotary shaft 18 extends. The rotary shaft 18 is rotatably supported by the front housing 12 and the cylinder block 11 through radial bearings 19, 20, respectively. The rotary shaft 18 extends out of the pressure control chamber 121 and drive power of a vehicle engine E as an external drive source is transmitted to the rotary shaft 18.

A lug plate 21 is fixed on the rotary shaft 18. A swash plate 22 is supported by the rotary shaft 18 so that it is slidable in the axial direction of the rotary shaft 18 and inclinable relative to the axial direction. The lug plate 21 has a pair of guide holes 211. A pair of guide pins 23 are provided on the swash plate 22 and slidably fitted in the paired guide holes 211, respectively. The guide holes 211 and the guide pins 23 cooperate to allow the swash plate 22 to incline relative to the axial direction of the rotary shaft 18 and also to rotate integrally with the rotary shaft 18. The inclination of the swash plate 22 is guided by the guide holes 211 along which the guide pins 23 slide, respectively, and the rotary shaft 18 which slidably supports the swash plate 22.

As the center of the swash plate 22 moves toward the lug plate 21, the inclination angle of the swash plate 22 increases. The maximum inclination of the swash plate 22, which is shown by solid line in FIG. 1, is restricted by contact of the swash plate 22 with the lug plate 21. The minimum inclination of the swash plate 22 is shown by chain double-dashed line in FIG. 1.

The cylinder block 11 forms therethrough a plurality of cylinder bores 111 in which pistons 24 are received. The rotation of the swash plate 22 is converted into the reciprocating movement of the pistons 24 through pairs of shoes 25, respectively.

The rear housing 13 has a suction chamber 131 as a suction pressure region and a discharge chamber 132. Suction ports 141 corresponding to the cylinder bores 111 are formed through the valve plate 14, the valve forming plate 16 and the retainer forming plate 17. Discharge ports 142 corresponding to the cylinder bores 111 are formed through the valve plate 14 and the valve forming plate 15. Suction valves 151 are formed on the valve forming plate 15, corresponding to the suction ports 141. Discharge valves 161 are formed on the valve forming plate 16, corresponding to the discharge ports 142. As the piston 24 moves leftward in its corresponding cylinder bore 111 as seen in FIG. 1, refrigerant or refrigerant gas is drawn from the suction chamber 131 into the cylinder bore 111 through its suction port 141 while pushing open its suction valve 151. As the piston 24 moves rightward in the cylinder bore 111 as seen in FIG. 1, the refrigerant gas is compressed in the cylinder bore 111 and discharged out into the discharge chamber 132 through its discharge port 142 pushing open its discharge valve 161. The discharge valve 161 then comes into contact with a retainer 171 on the retainer forming plate 17 thereby to restrict the opening of the discharge valve 161.

Figure 2:
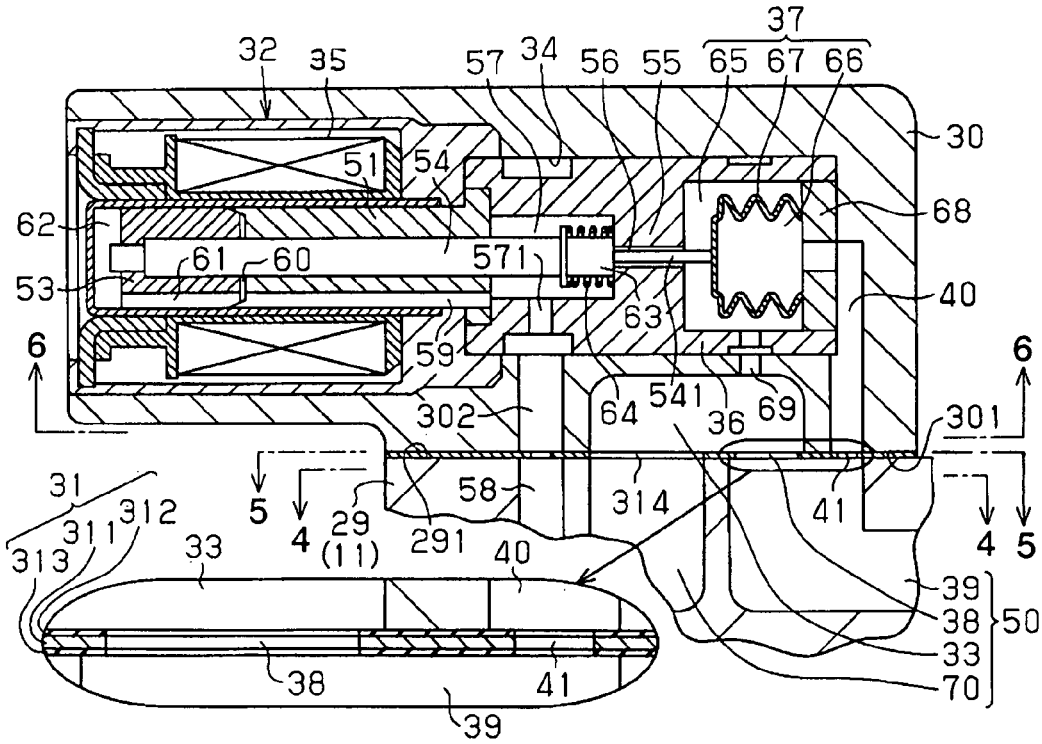
FIG. 2 is a partial enlarged view of FIG. 1.
Figure 3:
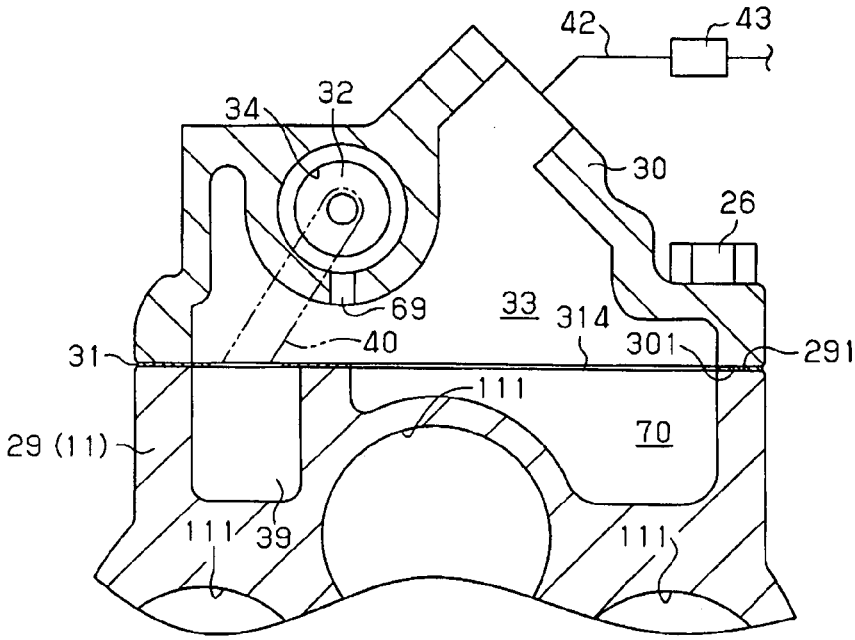
FIG. 3 is a cross sectional view taken along the line 3-3 of FIG. 1.
Figure 6:
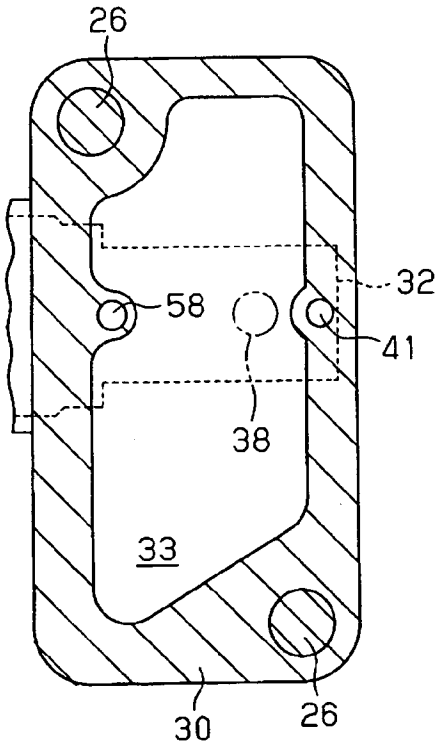
FIG. 6 is a cross sectional view taken along the line 6-6 of FIG. 2.

A projecting portion 29 is formed integrally with the cylinder block 11 on the top peripheral surface 110 thereof. As shown in FIG. 2, a top end 291 of the projecting portion 29 (the exterior surface of the cylinder block 11) is formed in a flat shape, and a muffler forming member 30 as a passage forming member is connected to the top end 291 of the projecting portion 29 through a flat-shaped sealing gasket 31 as a flat partition. The gasket 31 is formed by applying rubber layers 312, 313 by baking process on opposite sides of a metal plate 311 as a core material. Resin layers may be applicable instead of the rubber layers 312, 313. The gasket 31 prevents the refrigerant gas from leaking through the gap between the projecting portion 29 and the muffler forming member 30. As shown in FIG. 3, the muffler forming member 30 and the gasket 31 are jointly fastened via screws 26.

As shown in FIG. 2, the muffler forming member 30 has a first muffler chamber 33 and an accommodation chamber 34, in which a displacement control valve 32 is accommodated. A second muffler chamber 70 is recessed in the projecting portion 29 (cylinder block 11) and is in communication with the first muffler chamber 33 through a port 314 penetrating through the gasket 31.

Figure 5:
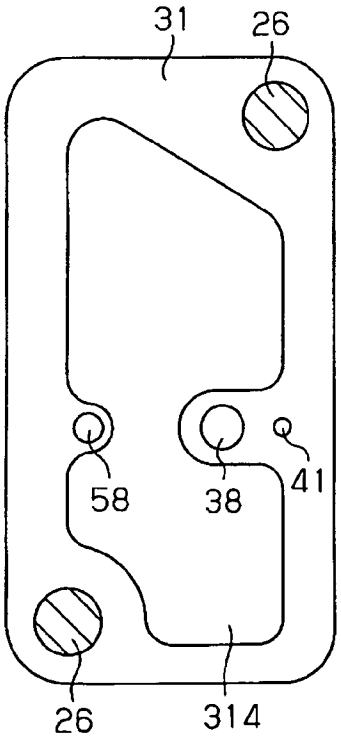
FIG. 5 is a cross sectional view taken along the line 5-5 of FIG. 2.
Figure 4:
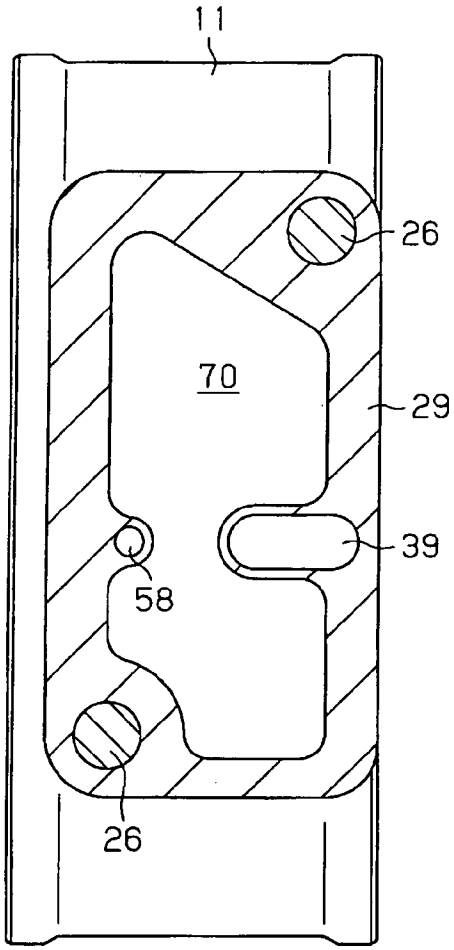
FIG. 4 is a cross sectional view taken along the line 4-4 of FIG. 2.

An upstream passage 39 is formed in the valve plate 14 and the cylinder block 11 and communicates with the discharge chamber 132. A throttle 38 penetrates through the gasket 31 in the through-thickness direction and communicates with the upstream passage 39 and the first muffler chamber 33. The discharge chamber 132, the upstream passage 39, the throttle 38 and the muffler chambers 33, 70 form a discharge pressure region. FIG. 4 shows the upstream passage 39 formed in the cylinder block 11, and FIG. 5 shows the throttle 38 penetrating through the gasket 31.

As shown in FIG. 2, the first muffler chamber 33 communicates with the discharge chamber 132 through the throttle 38 formed in the gasket 31 and the upstream passage 39 formed in the cylinder block 11. The refrigerant gas in the discharge chamber 132 flows out to an external refrigerant circuit 42 through the upstream passage 39, the throttle 38 and the first muffler chamber 33. The upstream passage 39, the throttle 38 and the first muffler chamber 33 form a discharge passage 50 for allowing the refrigerant gas to be discharged out of the housing assembly of the variable displacement compressor 10. The discharge passage 50 as a refrigerant passage is divided into the upstream passage 39 and the first muffler chamber 33 as a downstream passage by the throttle 38.

The refrigerant gas discharged out to the external refrigerant circuit 42 returns to the suction chamber 131. In the external refrigerant circuit 42 are disposed a condenser 43 for removing heat from the refrigerant gas, an expansion valve 44 and an evaporator 45 for allowing the refrigerant gas to absorb the ambient heat. The expansion valve 44 is operable to control the flow rate of the refrigerant gas according to variation in the temperature of the refrigerant gas at the outlet of the evaporator 45.

The refrigerant gas flowing from the upstream passage 39 into the first muffler chamber 33 through the throttle 38 is throttled by the throttle 38, which produces the difference of pressure between the upstream passage 39 and the first muffler chamber 33. The pressure in the first muffler chamber 33 is lower than that in the upstream passage 39.

The displacement control valve 32 has a solenoid 35 that includes a fixed core 51 and a movable core 53. Supplying electric current to the solenoid 35, the fixed core 51 is magnetized to attract the movable core 53 thereto. The solenoid 35 is controlled by a controller C (shown in FIG. 1) with electric current. In this embodiment, the solenoid 35 is controlled by the controller C with duty ratio. A transmitting rod 54 is fixed to the movable core 53.

The displacement control valve 32 has a valve housing 36 that includes a valve hole forming wall 55, in which a valve hole 56 is formed. The valve hole forming wall 55 and the fixed core 51 define a valve chamber 57. The valve hole 56 is connected to the valve chamber 57, and the valve chamber 57 communicates with the pressure control chamber 121 through passages 571, 302, 58 and a bolt hole 112 (shown in FIG. 1). The transmitting rod 54 is formed integrally with a valve body 63. The valve body 63 is operable to open and close the valve hole 56. The transmitting rod 54 is urged by a spring 64 in a direction in which the movable core 53 is moved away from the fixed core 51.

The valve chamber 57 communicates with an opening 60 between the movable core 53 and the fixed core 51 through a passage 59. The valve chamber 57 also communicates with a back pressure chamber 62 located at the back of the movable core 53 through the passage 59 and a passage 61. That is, the pressure in the pressure control chamber 121 (control pressure) reaches the back pressure chamber 62 through the valve chamber 57 and the passages 59, 61.

The displacement control valve 32 has a first pressure sensing chamber 65, a second pressure sensing chamber 66 and a bellows 67. The first pressure sensing chamber 65 and the second pressure sensing chamber 66 are separated by the bellows 67 whose fixed end is connected to an end wall 68 included in the valve housing 36. A small-diameter portion 541 of the transmitting rod 54 is joined to the movable end of the bellows 67. The transmitting rod 54 is movable in conjunction with the bellows 67.

The first pressure sensing chamber 65 communicates with the first muffler chamber 33 through the pressure acting passage 69 and the second pressure sensing chamber 66 communicates with the upstream passage 39 through a pressure acting passage 40. That is, the pressure in the first pressure sensing chamber 65 corresponds to the pressure in the first muffler chamber 33 downstream of the throttle 38, and the pressure in the second pressure sensing chamber 66 corresponds to the pressure in the upstream passage 39 upstream of the throttle 38. The pressure in the first pressure sensing chamber 65 and the pressure in the second pressure sensing chamber 66 are opposed to each other through the bellows 67.

As shown in FIG. 2, the gasket 31 is provided with a hole 41 so as to penetrate through the gasket 31 in the through-thickness direction and the hole 41 forms a part of the pressure acting passage 40. The cross sectional area of the hole 41 formed in the gasket 31 is set smaller than that of the pressure acting passage 40 formed in the muffler forming member 30. The pressure acting passage 40 is formed in a linear shape so as to extend linearly from a facing surface 301 (see FIGS. 2 and 3) of the muffler forming member 30 relative to the projecting portion 29 (cylinder block 11) to the displacement control valve 32.

As the flow rate of discharge refrigerant gas flowing through the discharge passage 50 increases, the pressure difference between the upstream passage 39 and the first muffler chamber 33 increases. On the other hand, as the flow rate of discharge refrigerant gas flowing through the discharge passage 50 decreases, the pressure difference between the upstream passage 39 and the first muffler chamber 33 decreases. As the pressure difference between upstream and downstream of the throttle 38 increases, the pressure difference between the first and second pressure sensing chambers 65 and 66 increases. As the pressure difference between upstream and downstream of the throttle 38 decreases, the pressure difference between the first and second pressure sensing chambers 65 and 66 decreases. The pressure difference between the first and second pressure sensing chambers 65 and 66 produces a force urging the transmitting rod 54 in the direction from the valve hole 56 toward the valve chamber 57.

The first and second pressure sensing chambers 65 and 66 and the bellows 67 form a pressure sensing means 37 of the present invention for sensing the pressure difference between upstream and downstream of the throttle 38. The opening and closing operation of the valve hole 56 depends on the balance among various forces such as the electromagnetic force generated by the solenoid 35, the urging force resulting from the pressure (control pressure) in the back pressure chamber 62 and urging the transmitting rod 54 in the direction to close the valve hole 56, the spring force of the spring 64 and the urging force of the pressure sensing means 37.

The pressure sensing means 37 is operable to sense the pressure at a first point (or in the first muffler chamber 33) and the pressure at a second point (or in the upstream passage 39) in the discharge pressure region and to adjust the position of the transmitting rod 54 or the valve body 63 based on the pressure difference between the above first and second points.

As shown in FIG. 1, the controller C, which controls the solenoid 35 of the displacement control valve 32 with electric current (duty ratio), supplies electric current to the solenoid 35 while the air conditioner switch (not shown) is turned on. With the air conditioner switch turned off, the controller C stops supplying the electric current to the solenoid 35. A room temperature setting device 47 and a room temperature sensor 48 are electrically connected to the controller C. With the air conditioner switch turned on, the controller C controls the electric current supplied to the solenoid 35 based on the difference between a target temperature set by the room temperature setting device 47 and a temperature then sensed by the room temperature sensor 48. As the duty ratio is increased, the transmitting rod 54 (the valve body 63) moves in the direction from the valve chamber 57 toward the valve hole 56.

As shown in FIG. 2, the refrigerant gas in the first muffler chamber 33 can flow into the pressure control chamber 121 through the passage 69, the first pressure sensing chamber 65, the valve hole 56, the valve chamber 57 and the passage 58. The valve opening of the displacement control valve 32 is adjusted depending on the duty ratio of the electricity to the solenoid 35 of the displacement control valve 32. With the valve hole of the displacement control valve 32 closed, no refrigerant gas in the discharge chamber 132 flows into the pressure control chamber 121. The passage 69, the first pressure sensing chamber 65, the valve hole 56, the valve chamber 57 and the passages 571, 302, 58 form a supply passage for allowing the refrigerant gas in the discharge pressure region to be supplied into the pressure control chamber 121.

As shown in FIG. 1, the pressure control chamber 121 communicates with the suction chamber 131 through a bleed passage 28. The bleed passage 28 is formed in the cylinder block 11, the valve forming plate 15, the valve plate 14, the valve forming plate 16 and the retainer forming plate 17. Thus, the refrigerant gas in the pressure control chamber 121 can flow out thereof into the suction chamber 131 through the bleed passage 28. As the valve opening of the displacement control valve 32 is increased, the flow rate of the refrigerant gas flowing from the discharge chamber 132 to the pressure control chamber 121 through the supply passage increases, so that the pressure in the pressure control chamber 121 increases. Thus, the inclination of the swash plate 22 decreases to decrease the displacement of the variable displacement compressor 10. As the valve opening of the displacement control valve 32 is decreased, the flow rate of the refrigerant gas flowing from the discharge chamber 132 to the pressure control chamber 121 through the supply passage decreases, so that the pressure in the pressure control chamber 121 decreases. Thus, the inclination of the swash plate 22 increases to increase the displacement of the variable displacement compressor 10.

The controller C controls the electric current supplied to the solenoid 35 so that the temperature sensed by the room temperature sensor 48 converges to the target temperature set by the room temperature setting device 47.

According to the present embodiment, the following advantageous effects are obtained.

(1) In the structure where the displacement control valve 32 is provided in the muffler forming member 30, there is no structural complexity of the passages (pressure acting passage 40 and the passage 69) through which the pressure of the refrigerant gas (pressure in the upstream passage 39) upstream of the throttle 38 formed in the gasket 31 and the pressure of the refrigerant gas (pressure in the first muffler chamber 33) downstream of the throttle 38 respectively act on the displacement control valve 32. Therefore, weighting of the muffler forming member 30 due to the structural complexity of the passages is not caused thereby to prevent weighting of the variable displacement compressor 10.

(2) The size (cross sectional area and length) of the throttle provided in the passage of discharge refrigerant gas is an important element to cause appropriate pressure difference. In the structure where the throttle is provided in the housing assembly of the variable displacement compressor 10 or the muffler forming member 30, however, it is difficult to accurately form the throttle with a desired size (cross sectional area and length). In the structure where the throttle 38 penetrates through the flat gasket 31, the throttle 38 can be formed by press, so that the throttle 38 is formed accurately so as to have a desired cross sectional area. If the gasket 31 whose thickness coincides with a desired length of the throttle 38 is employed, the length of the formed throttle 38 becomes the desired length. Therefore, the throttle 38 for producing the pressure difference can be formed accurately.

(3) Since the rear housing 13 is not provided with the displacement control valve 32, the volume of the suction chamber 131 or the discharge chamber 132 inside the rear housing 13 is increased. Increasing the volume of the suction chamber 131 or the discharge chamber 132 is effective in preventing suction pulsation or discharge pulsation.

(4) The pressure in the upstream passage 39 acts on the second pressure sensing chamber 66 through the pressure acting passage 40. As the cross sectional area of the pressure acting passage 40 is set smaller, the pressure of the discharge refrigerant gas flowing through the upstream passage 39 is less affected on the displacement control valve 32. The structure where the hole 41 forming a part of the pressure acting passage 40 penetrates through the gasket 31 is profitable for decreasing the cross sectional area of the hole 41.

(5) If an extra space formed by molding and a bore formed by drilling from the space cooperate to form the pressure acting passage, the volume of the first muffler chamber 33 is restricted due to the space. In the structure where the pressure acting passage 40 inside the muffler forming member 30 is formed in a linear shape, it is easy to form the pressure acting passage 40 inside the muffler forming member 30 by drilling and there is no extra space described above. Therefore, the volume of the first muffler chamber 33 is increased.

(6) The gasket 31 interposed between the cylinder block 11 and the muffler forming member 30 is simple and easy, and suitable for the place where the throttle 38 and the hole 41 are provided.

(7) The pressure in the first muffler chamber 33 acts on the first pressure sensing chamber 65 which opens into the first muffler chamber 33. The structure of the passage through which the first pressure sensing chamber 65 communicates with the first muffler chamber 33 is simple. The structure where the first muffler chamber 33 forms a downstream passage of the discharge passage 50 simplifies the structure of the passage through which the pressure in the downstream passage acts on the displacement control valve 32.

(8) The gasket 31 having the metal plate 311 as a core material is suitable for enhancing the accuracy of opening a hole by pressing process.

(9) The second muffler chamber 70 forms a part of the downstream passage of the discharge passage 50 and increases the entire volume of the muffler chambers 33 and 70 thereby to improve the noise reduction effect.

(10) The second muffler chamber 70, the passage 58 and the upstream passage 39 can be simultaneously formed by using a mold for forming the cylinder block 11. The passage 302 and the pressure acting passage 40 can be simultaneously formed by using a mold for forming the muffler forming member 30. This contributes to the reduction of the manufacturing process.

According to the present invention, the following embodiments may also be applied.

A seal ring may be interposed between the projecting portion 29 and the muffler forming member 30 so as to surround the periphery of the partition having a throttle 38.

A seal ring may also be interposed between the projecting portion 29 and the muffler forming member 30 so as to surround the periphery of the partition having a hole 41.

A diaphragm or a piston may be used instead of the bellows 67 of the pressure sensing means 37 of the displacement control valve 32.

Providing the passage forming member between the external refrigerant circuit 42 and the suction chamber 131 and interposing the gasket between the housing assembly of the variable displacement compressor and the passage forming member, the throttle may penetrate through the gasket having the displacement control valve in the passage forming member. The displacement control valve of this case controls the pressure difference between two points (pressure difference between upstream and downstream of the throttle) of the pressure (suction pressure) of the refrigerant gas flowing through the refrigerant passage (suction passage) from the external refrigerant circuit 42 to the suction chamber 131.

The second muffler chamber 70 of the first embodiment may be eliminated.

The passage 58 of the first embodiment may be formed to directly communicate with the pressure control chamber 121 without passing through the bolt hole 112 (see FIG. 1).

Although in the first embodiment the muffler forming member 30 is connected to the top peripheral surface 110 of the cylinder block 11 through the gasket 31, the muffler forming member 30 may be connected to the exterior surface of the front housing 12 or the exterior surface of the rear housing 13. Instead, the muffler forming member 30 may be connected to the exterior surfaces extended over two or more members of the cylinder block 11, the front housing 12 and the rear housing 13.

Therefore, the present examples and embodiments are to be considered as illustrative and not restrictive, and the invention is not to be limited to the details given herein but may be modified within the scope of the appended claims.

What is claimed is:

1. A displacement control structure for a variable displacement compressor that includes a housing assembly having a pressure control chamber and a suction pressure region, wherein refrigerant in a discharge pressure region is supplied to the pressure control chamber through a supply passage while the refrigerant in the pressure control chamber flows into the suction pressure region through a bleed passage whereby pressure in the pressure control chamber is adjusted to control displacement of the compressor, comprising:

a passage forming member connected to an exterior surface of the housing assembly for forming a refrigerant passage for allowing the refrigerant to be discharged out from the compressor to an external refrigerant circuit;

a flat partition interposed between the passage forming member and the housing assembly, wherein a throttle penetrates through the partition, which divides the refrigerant passage into an upstream passage and a downstream passage; and a displacement control valve provided in the passage forming member, wherein the displacement control valve senses pressure of the refrigerant in the upstream passage and pressure of the refrigerant in the downstream passage to control the flow rate of the refrigerant flowing through the supply passage.

2. The displacement control structure according to claim 1, wherein a pressure acting passage penetrates through the partition, wherein the pressure in the upstream passage acts on the displacement control valve through the pressure acting passage.

3. The displacement control structure according to claim 1, wherein the downstream passage is a muffler chamber.

4. The displacement control structure according to claim 1, wherein the housing assembly includes a cylinder block, the passage forming member being connected to a top end of a projecting portion of the cylinder block.

5. The displacement control structure according to claim 1, wherein the partition is a gasket interposed between the housing assembly and the passage forming member.

6. The displacement control structure according to claim 5, wherein the gasket is formed by providing rubber layers on opposite sides of a metal plate.

7. The displacement control structure according to claim 5, wherein the gasket is formed by providing resin layers on opposite sides of a metal plate.

* * * * *